US011926448B2

(12) United States Patent
Karsten

(10) Patent No.: US 11,926,448 B2
(45) Date of Patent: Mar. 12, 2024

(54) CONTAINER DEVICES, SYSTEMS, AND METHODS

(71) Applicant: Joel Karsten, Roseville, MN (US)

(72) Inventor: Joel Karsten, Roseville, MN (US)

( * ) Notice: Subject to any disclaimer, the term of this patent is extended or adjusted under 35 U.S.C. 154(b) by 315 days.

(21) Appl. No.: 17/181,263

(22) Filed: Feb. 22, 2021

(65) Prior Publication Data

US 2021/0261288 A1 Aug. 26, 2021

Related U.S. Application Data

(60) Provisional application No. 62/980,481, filed on Feb. 24, 2020.

(51) Int. Cl.
*B65D 8/00* (2006.01)

(52) U.S. Cl.
CPC ..... *B65D 15/24* (2013.01); *B65D 15/22* (2013.01); *B65D 2203/10* (2013.01)

(58) Field of Classification Search
CPC ..... B65D 7/24; B65D 11/1873; B65D 15/04; A63H 33/101; A63H 33/102; A63H 33/107; A63H 33/062
See application file for complete search history.

(56) References Cited

U.S. PATENT DOCUMENTS 2,057,942 A * 10/1936 Aurele ..... A63H 33/108 446/112
2,776,521 A 1/1957 Zimmerman
4,055,019 A * 10/1977 Harvey ..... A63H 33/065 446/124
4,581,793 A * 4/1986 Micklitz ..... A63H 33/102 24/297
4,750,317 A * 6/1988 Vrana ..... B65B 5/06 53/247
4,874,341 A 10/1989 Ziegler
5,100,358 A * 3/1992 Volgger ..... A63H 33/08 446/104
5,501,626 A 3/1996 Harvey
5,822,714 A 10/1998 Cato
6,094,173 A 7/2000 Nylander
6,142,848 A 11/2000 Madner et al.
(Continued)

FOREIGN PATENT DOCUMENTS

WO 2015075107 A1 5/2015

*Primary Examiner* — Anthony D Stashick
*Assistant Examiner* — Blaine G Neway
(74) *Attorney, Agent, or Firm* — Fredrikson & Byron, P.A.

(57) ABSTRACT

A system of attachable walls includes first and second walls. Each such wall includes a first side having a base surface and a repeatable pattern. The repeatable pattern includes first, second, third, and fourth lateral segments. The second lateral segment includes a resilient first flange extending outward and a flexible finger extending outward. The flexible finger has a first side facing the resilient first flange, a second side, opposite the first, facing away from the resilient first flange and toward the first lateral segment, a first mating component positioned on the second side of the flexible finger, and a receptacle formed between the resilient first flange and the flexible finger. The fourth lateral segment includes a second flange extending away from the base surface of the first side. The second flange includes a second mating component positioned on a side of the second flange facing the third lateral segment.

26 Claims, 13 Drawing Sheets

(56) References Cited

U.S. PATENT DOCUMENTS

| | | | | |
|---|---|---|---|---|
| 6,204,764 | B1 | 3/2001 | Maloney | |
| 6,520,544 | B1 * | 2/2003 | Mitchell | B65D 25/205 283/67 |
| 6,648,715 | B2 * | 11/2003 | Wiens | A63H 33/062 446/124 |
| 6,724,308 | B2 | 4/2004 | Nicholson | |
| 7,478,734 | B2 * | 1/2009 | Vargas | B65D 7/24 220/668 |
| 7,573,370 | B2 | 8/2009 | Becker et al. | |
| 7,648,407 | B1 * | 1/2010 | Sorensen | A63H 33/084 446/124 |
| 7,932,824 | B2 * | 4/2011 | Flores | G07G 1/009 340/568.1 |
| 7,973,644 | B2 | 7/2011 | Tuttle | |
| D645,912 | S | 9/2011 | Hardstaff | |
| 8,253,537 | B2 | 8/2012 | Inagaki | |
| 8,395,508 | B2 | 3/2013 | Burnside et al. | |
| 9,054,881 | B2 | 6/2015 | Lee et al. | |
| 9,123,016 | B2 | 9/2015 | Jones et al. | |
| 9,129,169 | B1 | 9/2015 | Diorio et al. | |
| 9,324,053 | B1 | 4/2016 | Lavra et al. | |
| 9,327,870 | B2 | 5/2016 | Jian et al. | |
| 9,384,376 | B2 | 7/2016 | Sabesan et al. | |
| 9,805,235 | B2 | 10/2017 | Kruest et al. | |
| 9,886,661 | B1 | 2/2018 | Tercsinecz | |
| 9,916,555 | B2 | 3/2018 | Wible et al. | |
| 10,061,950 | B1 | 8/2018 | Pesavento et al. | |
| 10,304,030 | B1 | 5/2019 | Tzannakos | |
| 10,346,656 | B2 | 7/2019 | Wilkinson | |
| 10,370,153 | B2 | 8/2019 | Brignola et al. | |
| 2006/0125653 | A1 | 6/2006 | McQuade | |
| 2007/0051055 | A1 | 3/2007 | Lin | |

* cited by examiner

CONTAINER DEVICES, SYSTEMS, AND METHODS

RELATED APPLICATION

This application claims priority to U.S. provisional patent application No. 62/980,481, filed on Feb. 24, 2020.

TECHNICAL FIELD

The present disclosure generally relates to container devices, systems, and methods. In various such embodiments, container devices and systems are configured for holding items in transport and shipping, and these embodiments can provide such container devices and systems that are reusable in subsequent transport and shipping applications. Moreover, various such embodiments can provide modular container devices and systems that can be assembled from a number of individual wall components so as to form a container with dimensions as suited for the particular items that are the subject of the transport and shipping application.

BACKGROUND

Conveying goods between parties at different locations generally requires that these goods be shipped to the desired location. Currently, corrugated boxes are used as a common means for holding such goods during shipping. Once an item is received at the desired location, the item is removed from the corrugated box and the corrugated box is discarded.

However, the rapid rise of e-commerce transactions pertaining to tangible goods has caused a correspondingly rapid rise in the amount of packaging consumption and waste. Even where discarded corrugated boxes are recyclable, the amount of energy needed to recycle the corrugated box may be considerable, even at times exceeding the benefit of converting the discarded corrugated into a reusable form.

SUMMARY

The present application discloses container device, system, and method exemplary embodiments. In particular, disclosed herein are exemplary container devices and systems that can be reusable in subsequent transport and shipping applications. Accordingly, embodiments disclosed herein can reduce inputs, reduce the carbon footprint, and lower costs associated with the shipping of tangible goods. Moreover, such embodiments can provide modular container devices and systems that can be assembled from a number of individual wall components so as to form a container with dimensions as suited for the particular tangible goods that are the subject of the transport and shipping application.

One exemplary embodiment includes a system of attachable walls. This system embodiment includes a first wall and a second wall. Each of the first wall and the second wall includes a first side having a base surface and a repeatable pattern. The repeatable pattern includes a first lateral segment, a second lateral segment, a third lateral segment, and fourth lateral segment. The second lateral segment is adjacent to the first lateral segment. The second lateral segment includes a resilient first flange extending outward of the base surface of the first side and a flexible finger extending outward of the base surface of the first side. The flexible finger has a first side facing the resilient first flange, a second side, opposite the first side, facing away from the resilient first flange and toward the first lateral segment, a first mating component positioned on the second side of the flexible finger, and a receptacle formed between the resilient first flange and the flexible finger. The receptacle is configured to receive a pin and hold the pin at the receptacle such that, when the pin is inserted into the receptacle, the flexible finger is prevented from flexing toward the resilient first flange. The third lateral segment is adjacent to the second lateral segment such that the second lateral segment is between the first lateral segment and the third lateral segment. The fourth lateral segment is adjacent to the third lateral segment such that the third lateral segment is between the second lateral segment and the fourth lateral segment. The fourth lateral segment includes a second flange extending away from the base surface of the first side. The second flange includes a second mating component positioned on a side of the second flange facing the third lateral segment. The first side of the first wall is configured to engage with the first side of the second wall such that: the first lateral segment of the first wall receives the second flange of the fourth lateral segment of the second wall; the first lateral segment of the second wall receives the second flange of the fourth lateral segment of the first wall; the third lateral segment of the first wall receives the flexible finger and the resilient first flange of the second lateral segment of the second wall; the third lateral segment of the second wall receives the flexible finger and the resilient first flange of the second lateral segment of the first wall; the first mating component of the first wall engages the second mating component of the second wall; and the first mating component of the second wall engages the second mating component of the first wall. And, when the first side of the first wall engages the first side of the second wall, the first wall is rotatable relative to the second wall about a rotational axis defined by the first mating component of the first wall and the second mating component of the second wall.

BRIEF DESCRIPTION OF DRAWINGS

Advantages of the present invention may become apparent to those skilled in the art with the benefit of the following detailed description and upon reference to the accompanying drawings, wherein like numerals denote like elements.

DETAILED DESCRIPTION OF THE INVENTION

The following detailed description is exemplary in nature and is not intended to limit the scope, applicability, or configuration of the invention in any way. Rather, the following description provides some practical illustrations for implementing various embodiments of the present invention. Unless otherwise noted, illustrations of various aspects of the disclosure are not necessarily drawn to scale. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
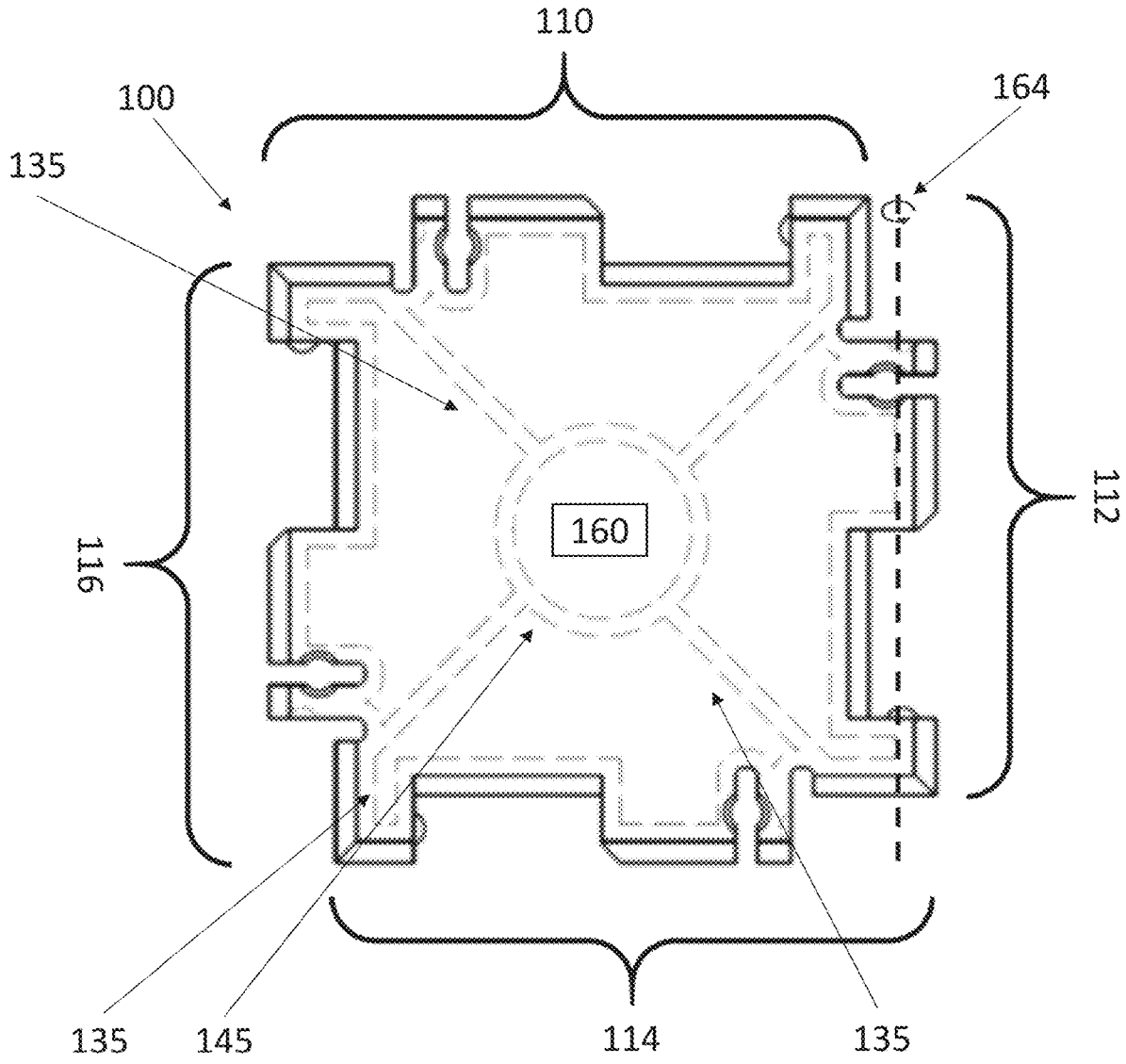
FIG. 1 is a top plan view of an exemplary embodiment of a wall. The wall in FIG. 1 can be included in a system of attachable walls.

FIG. 1 illustrates an exemplary embodiment of a wall 100. The wall 100 can be attachable to one or more other walls (e.g., similar to, or the same as, the wall 100) and together these walls can form a container, such as for use in holding tangible items in shipping applications. The wall 100 may comprise a plurality of sides, such as a first side 110, a second side 112, a third side 114, and a fourth side 116. Even though wall 100 is shown to comprise four sides, walls with other numbers of sides are within the scope of the present disclosure. In some embodiments, one or more sides of the wall 100 can include a repeatable pattern, such as a tessellation. Likewise, wall 100 along with one or more walls of a different size or shape may be connected to form semi-regular tessellations and/or polymorph tessellations. The shapes and configurations of walls (e.g., the wall 100) are discussed further herein. When wall 100 is connected to an additional wall, as described herein, wall 100 may rotate relative to the additional, connected wall about a rotational axis 164, as described further herein. The rotational axis 164 can be present at one or more (e.g., each of) first side 110, second side 112, third side 114, and fourth side 116.

The wall 100 may include one or more support flanges, such as support flanges 135. Support flanges 135 may be used to add structural stability to reinforce and provided added durability to a wall and/or have alternative uses while packing as discussed herein. Support flanges 135 can extend out from the wall and comprise supports around the peripheral of the wall; supports on or near the center of the wall; and supports traversing from the peripheral of the wall towards the interior of the wall.

In some embodiments, wall 100 may additionally include one or more attachment points, such as attachment point 145. Attachment point 145 may, for instance, be at a different elevation than a base surface of the wall 100 and, thus, may be recessed into the base surface of wall 100 or be extended out from the base surface of the wall 100 like the illustrated support flanges 135. For example, the attachment point 145 can be formed from one or more portions of support flanges 135, such as a center ring of the wall 100 as shown in FIG. 1. The attachment point 145 can be configured to be coupled to a pickup device that can be used to couple to and move and/or place the wall 100, such as attach the wall 100 to another wall. In such embodiments, the pickup device can include a coupling that is complementary to the attachment point 145 such that the coupling of the pickup device can removably secure to the attachment point 145. For example, the attachment point 145 can include a first fitting thereat and the coupling of the pickup device can include a second fitting thereat having a geometry that is complementary to, and configured to secure to, the first fitting of the attachment point (e.g., upon relative movement between the first fitting and the second fitting). In some embodiments, attachment point 145 (e.g., and the coupling with the second fitting) may be incorporated at another device, such as a drone, a packaging robot, and/or a device to be operable by a user. In such embodiments, the attachment point 145 may be used when assembling container using one or more walls; transporting walls or containers; and/or stacking walls or containers.

Wall 100 may comprise an identification component, such as identification component 160 as shown in FIG. 1. Identification component 160 may comprise a variety of devices, such as an RFID tag, a QR code, or other suitable identification devices. In one exemplary embodiment, the identification component 160 may be located near the center of wall 100, such as within attachment point 145. Identification component 160 may be used to uniquely identify the wall 100 and/or a container formed by the wall 100. In some embodiments, one or more walls may comprise one or more identification components 160, such that a container formed from the walls comprises multiple identification components 160 (e.g., a number of identification components 160 equal to the number of walls forming the container). In some embodiments, the identification component 160 may be used when constructing a container, organizing a container, packing a container, transporting a container, delivering a container, and/or disassembling a container.

Figure 2:
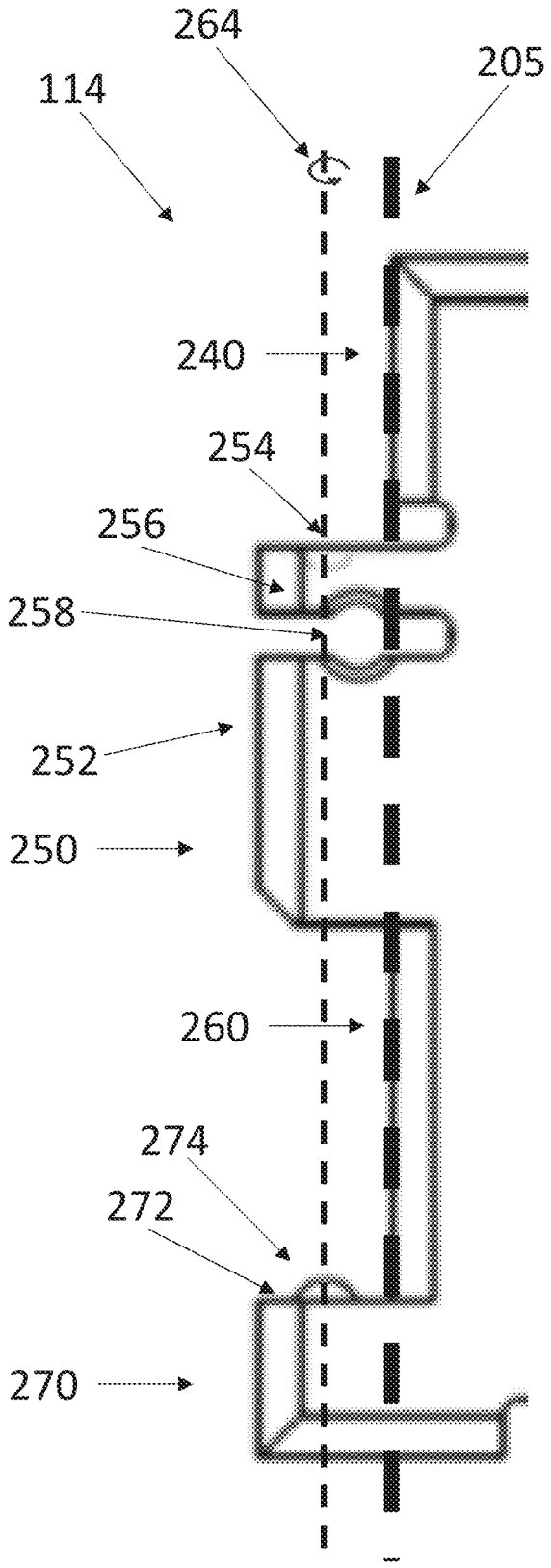
FIG. 2 is a top plan view of a first side of the wall of FIG. 1.

FIG. 2 shows a close-up view of the third side 114. The other sides of the wall 100 can include the same, or similar features, as those discussed here for the third side 114 (e.g., as illustrated in FIG. 1). As shown, the third side 114 may comprise a plurality of lateral segments, such as a first lateral segment 240, a second lateral segment 250, a third lateral segment 260, and a fourth lateral segment 270. In an exemplary embodiment, the plurality of lateral segments may be arranged such that a similar side of another wall (e.g. a wall comprising the third side 114 rotated 180 degrees) may be connected to the third side 114. As shown in FIG. 2, third side 114 may comprise a base surface 205 (shown as a dotted line). The first lateral segment 240 may be located on base surface 205. Additionally, the second lateral segment 250 may be located adjacent to the first lateral segment 240. The second lateral segment 250 may comprise a resilient first flange 252 and a flexible finger 256 extending outward of base surface 205. As shown, flexible finger 256 can have a first mating component 254 positioned on a side of flexible finger 256 facing away from resilient first flange 252 as well as a receptacle 258 formed between the resilient first flange 252 and the flexible finger 256.

When the similar side of another wall (e.g. a wall comprising the third side 114 rotated 180 degrees) is connected to the third side 114, the third side 114 may be rotatable relative to the similar side of another wall about a rotational axis 264 (e.g., "hinge" or "pivot" axis). In embodiments where the mating component(s) of one wall are configured to rotatably receive the corresponding mating components of another wall connected thereat, the corresponding mating features can form the rotational axis 264. Thus, the rotational axis 264 can extend through each of the first mating component 254 and the second mating component 274, as shown in FIG. 2. For example, rotational axis 264 may intersect the center of first mating component 254 and the second mating component 274.

The receptacle 258 can be configured to receive a pin and hold the pin at the receptacle 258 such that, when the pin is inserted into the receptacle 258, the flexible finger 256 is prevented from flexing toward the resilient first flange 252. As such, the receptacle 258 can be configured, when the receptacle receives the pin thereat, to limit the amount that the flexible finger 256 can flex, thereby increasing a locking force between a second mating component 274 and the first mating component 254. As shown, for example in FIG. 2, the receptacle 258 can be formed, at least in part, by the flexible finger 256. In particular, the receptacle 258 can be formed, at least in part, by a side surface of the flexible finger 256 facing the resilient first flange 252. As also shown, the receptacle 258 can be spaced off of the base surface 205, for instance a center point of the receptacle 258 can be spaced a distance, in a direction perpendicular to the extent of the base surface 205, away from the base surface 205. More particularly, the receptacle 258 can also be spaced off of the rotational axis 264 extending between the first mating component 254 and the second mating component 274, for instance the center point of the receptacle 258 can be spaced a distance, in a direction perpendicular to the extent of the base surface 205, away from the axis extending between the first mating component 254 and the second mating component 274. In the embodiment shown in FIG. 2, the center point of the receptacle 258 is located between the base surface 205 and the axis extending between the first mating component 254 and the second mating component 274.

The third side 114 may additionally include third lateral segment 260 adjacent to the second lateral segment 250 such that the second lateral segment 250 is between first lateral segment 240 and third lateral segment 260. In some embodiments, third lateral segment 260 may be on base surface 205. First side 110 may also include fourth lateral segment 270 located adjacent to third lateral segment 260 such that third lateral segment is between second lateral segment 250 and fourth lateral segment 270. Fourth lateral segment 270 may further include a second flange 272 which comprises a second mating component 274 positioned on the side of the second flange 272 facing the third lateral segment 260. In some embodiments, the first mating component 254 is configured to receive a second mating component 274 on a different wall.

Figure 3A:
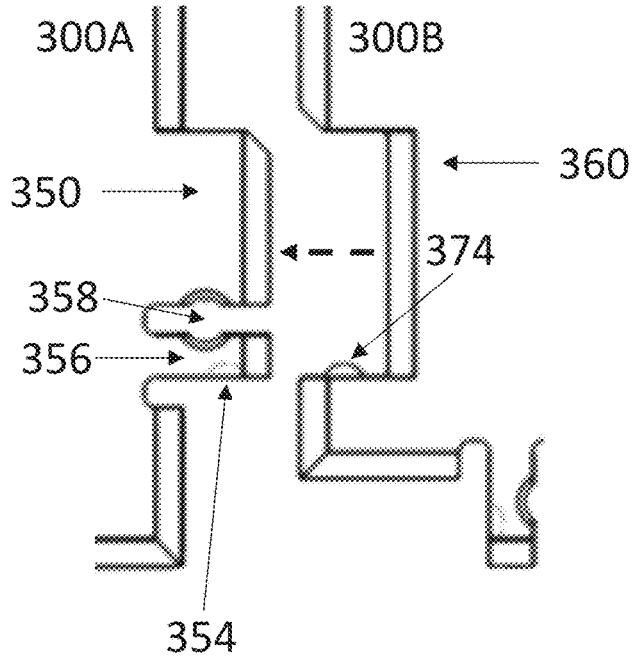
FIG. 3A-3D illustrate an exemplary embodiment of a sequence of connecting two walls.
Figure 3B:
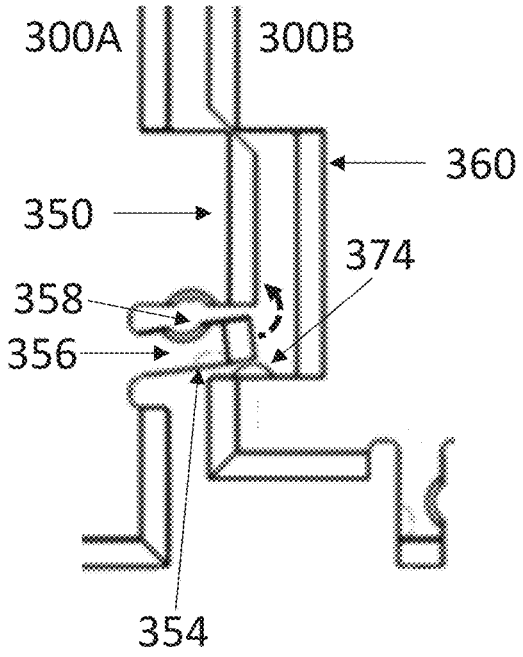
Figure 3C:
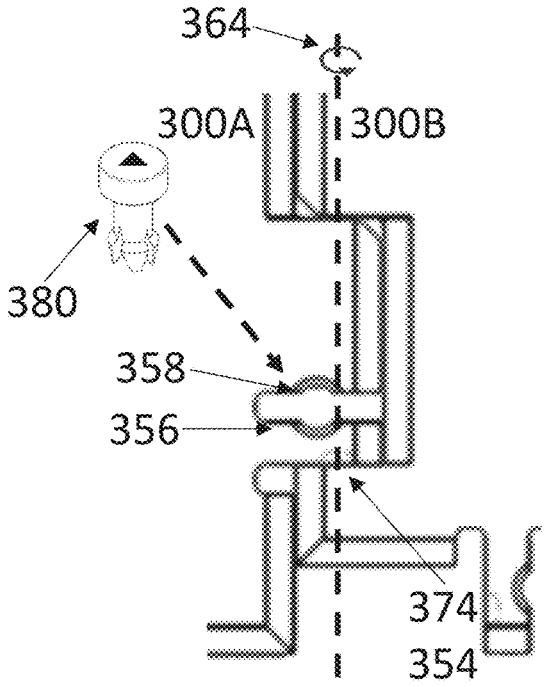
Figure 3D:
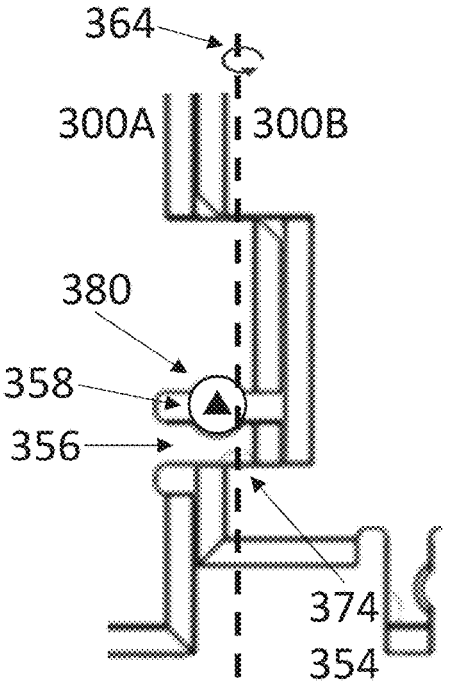

FIGS. 3A-D illustrate an embodiment where two walls, wall 300A and wall 300B, are attached. For simplicity, only a portion of wall 300A and wall 300B are shown, though it is to be understood that a repeatable pattern can be included at the interfacing sides of the walls 300A, 300B and the repeatable pattern can allow the walls 300A, 300B to attach as disclosed herein. In FIG. 3A, a second lateral segment 350 of wall 300A is aligned with a third lateral segment 360 of wall 300B. A first mating component 354 on wall 300A can be configured to receive a second mating component 374 on wall 300B. As shown in FIG. 3B, the flexible finger 356 can be configured to move away from second mating component 374 as wall 300A and 300B move together. Then, flexible finger 356 can be resilient and move back as second mating component 374 is received in first mating component 354, as shown in FIG. 3C. In some embodiments, it may be beneficial to lock walls 300A and 300B together, such that the walls will not easily be pulled apart. In some embodiments, walls 300A and 300B may be locked together with a locking mechanism, such as pin 380. As shown in FIG. 3C, and as described previously in reference to the receptacle in FIG. 2, a receptacle 358 can be configured to receive a pin 380, and the pin 380 can be inserted into the receptacle 358 on wall 300A. Then as shown in FIG. 3D, inserting the pin 380 limits the amount that the flexible finger 356 may flex, thus locking second mating component 374 into first mating component 354. This can provide added securement force between the attached walls 300A, 300B in a manner that can be able to increase the durability of a container formed from attached walls 300A, 300B.

The pin 380, as shown here, can include one or more flex features. The one or more flex features can be configured to be biased in a direction outward from a central longitudinal axis of the pin 380 and retract inward toward the central longitudinal axis of the pin 380 when encountering the receptacle 358 as a result of the receptacle 358 overcoming this bias force and pushing the one or more flex features inward. When biased outward, the one or more flex features can define a width of the pin 380 that is greater than the width of the receptacle 358, and, when in the inward position, the one or more flex features can define a width of the pin 380 that is less than the width of the receptacle 358. Thus, the pin 380, via the one or more flex features, can be configured to transition from a width less than the width of the receptacle 358 when the one or more flex features are in contact with the receptacle 358 to a width greater than the width of the receptacle 358 when the one or more flex features are not in contact with the receptacle 358 (e.g., once the one or more flex features have passed through the receptacle 358). In the illustrated embodiment, the pin 380 includes four flex features spaced about a perimeter of the pin 380 at a common axial location along the pin's central longitudinal axis at, or near, an axial end of the pin 380.

As shown in FIGS. 3C and 3D, attached walls 300A, 300B may be rotatable relative to each other about a rotational axis 364 when connected via first mating component 354 and second mating component 374. In the example shown in FIGS. 3C and 3D, rotational axis 364 may intersect the first mating component 354 and the second mating component 374. In such examples, the rotational axis 364 may also be parallel or relatively parallel to the second lateral segment 350 and third lateral segment 360. In some embodiments, each of the attached walls 300A, 300B may be rotatable about rotational axis 364 relative to the other of the attached walls 300A, 300B when connected without pin 380 (e.g. see FIG. 3C). Additionally or alternatively, the attached walls 300A, 300B may be rotatable about rotational axis 364 when connected with pin 380 (e.g. see FIG. 3D).

FIGS. 3A-D provide an exemplary embodiment of attaching and locking walls 300A and 300B together. However, alternative embodiments may be used even though not necessarily shown. For example, the shape and size of each wall may change, resulting in a different structure for mating. Additionally or alternatively, other locking mechanisms may be used.

Multiple walls may be joined together to make a geometrical net. For example, FIG. 4A details net 400 comprising six walls 402*a-f* joined together to make a geometrical net for a cube. In some embodiments, all six walls (e.g. 402*a-f*) may be further joined together using the connecting and locking mechanism/method as shown in FIGS. 3A-D, however other mechanisms and/or methods may be used. In such embodiments, the walls may be folded into a container, such as shown in FIG. 4B. In such an embodiment, either, or both, of walls may be pivoted (e.g., about a rotational axis, such as rotational axis 364) relative to one another to make a 90-degree angle, and the edges of the wall may be configured to slant at a 45-degree angle. However, when the walls are configured to fold into other geometrical shapes (e.g. various prisms, pyramids, polyhedrons, etc.) various other angles may be used. In some embodiments, a lower angle (e.g. 45-degree angle, 30-degree angle, etc.) may be used to allow for greater versatility when forming various shapes. In some embodiments, when two walls are connected together, the walls may be folded up to the sum of the two angles on the two walls. For example, when each wall has a 45-degree angle, the walls may be folded to a 90-degree angle. Then, if each wall has a 30-degree angle, the walls may be folded to a 60-degree angle. Furthermore, if one wall has a 45-degree angle and a second wall has a 30-degree angle, the walls may be folded to a 75-degree angle.

Figure 4A:
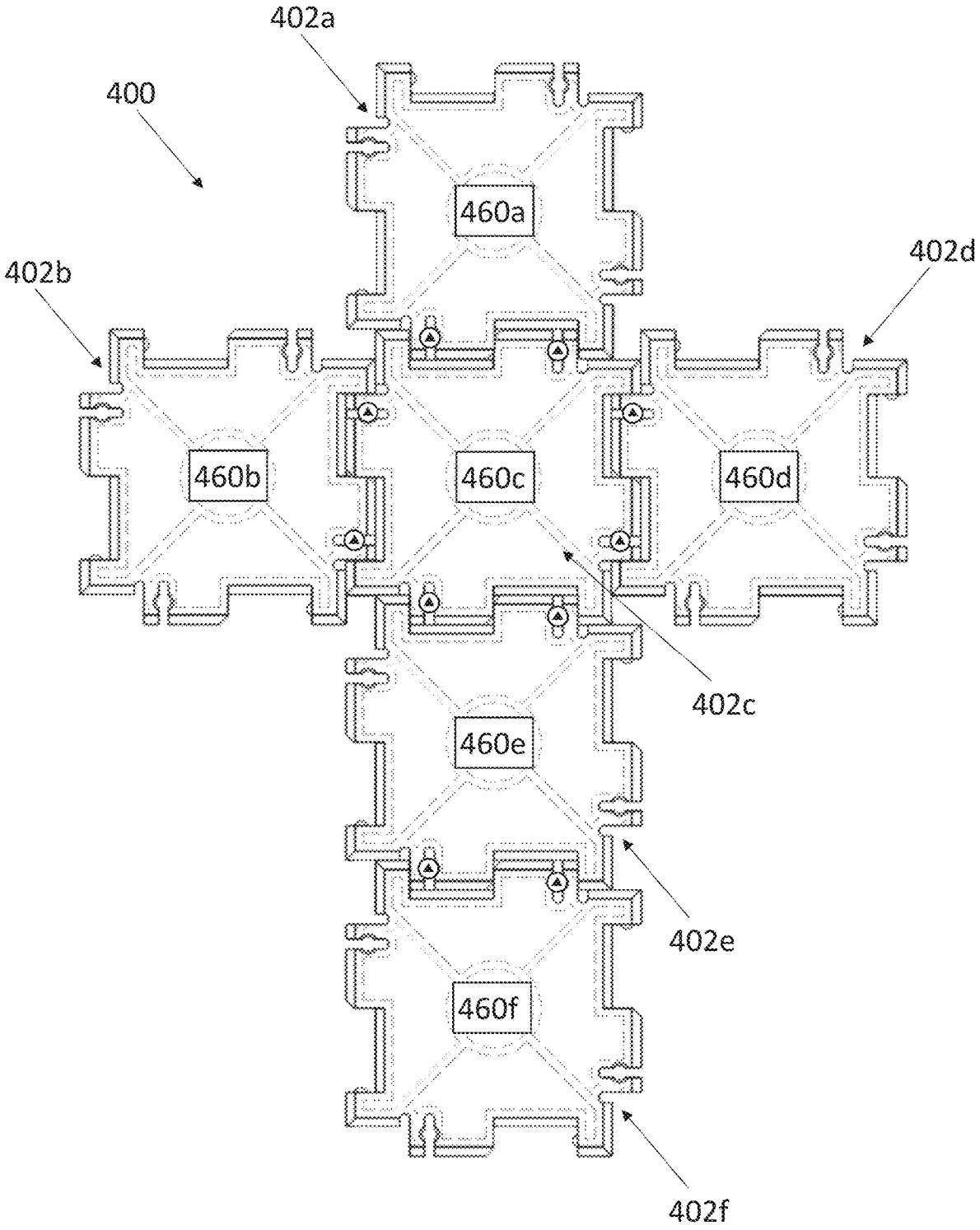
FIGS. 4A and 4B illustrate six walls that together can form one embodiment of a container.
Figure 4B:
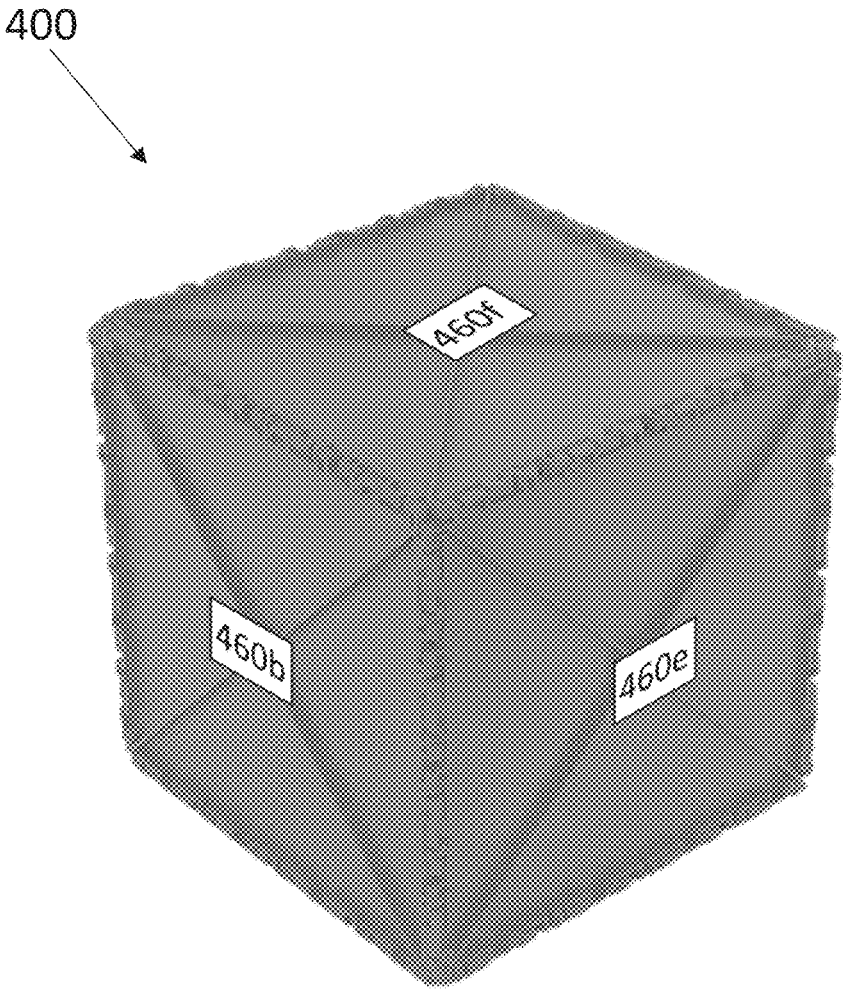

As shown in FIGS. 4A and 4B, one or more of walls 402*a-f* may comprise an identification component (e.g. identification components 460*a-f*), which can be similar to identification component 160 as described herein. In embodiments comprising an identification component, the identification component may be used for identifying a wall, a container formed multiple walls, and/or a side of a container. In an exemplary embodiment, a container may be identified by one or more of the identification components (e.g. identification components 460). In such embodiments, each identification component may individually comprise information about the container. Additionally or alternatively, each identification component may comprise different types of information about the container and/or the identification components when registered together may comprise information about the container.

In some embodiments, the one or more identification components 460*a-f* may be used during constructing containers and/or delivering containers. For example, each identification components 460*a-f* can provide a unique identifier for the wall it is associated with. Where a container is formed from multiple (e.g., six) walls, the container itself can have an associated aggregate unique identifier that is a combination of each of the multiple (e.g., six) individual unique identifiers provided by the respective identification component 460*a-f* of each wall. Accordingly, the aggregate unique identifier associated with the container can be used to identify the container.

With respect to forming a container, the one or more identification components may be used to identify which walls may be assembled into a geometrical net and/or container. In some embodiments, the information may be stored on the identification component on the wall, be used as an identification ID to look up information about the wall on something else, and/or a combination of both.

For example, each wall may have information pertaining to a property of the wall (e.g. size, shape, material, thickness, owner of the wall). Additionally or alternatively, each wall may have information regarding the strength of the wall (e.g. how much weight could be put into a container), the age of the wall (e.g. manufacture date, amount of times the wall has been previously used, etc.), and/or any restrictions/ratings for the wall (e.g. temperature rating, maximum weight, any deformities or missing pieces, etc.). Additionally or alternatively, the identification components may be used when joining two or more walls into a geometrical net or a container. For example, the identification components may be used to allow a user and/or machine to layout which components to join and in what orientation as well as which components to fold and in what orientation. In such examples, one or more walls may be selected from a group of walls to be joined and/or folded together to form a geometrical net and/or a container.

Figure 5A:
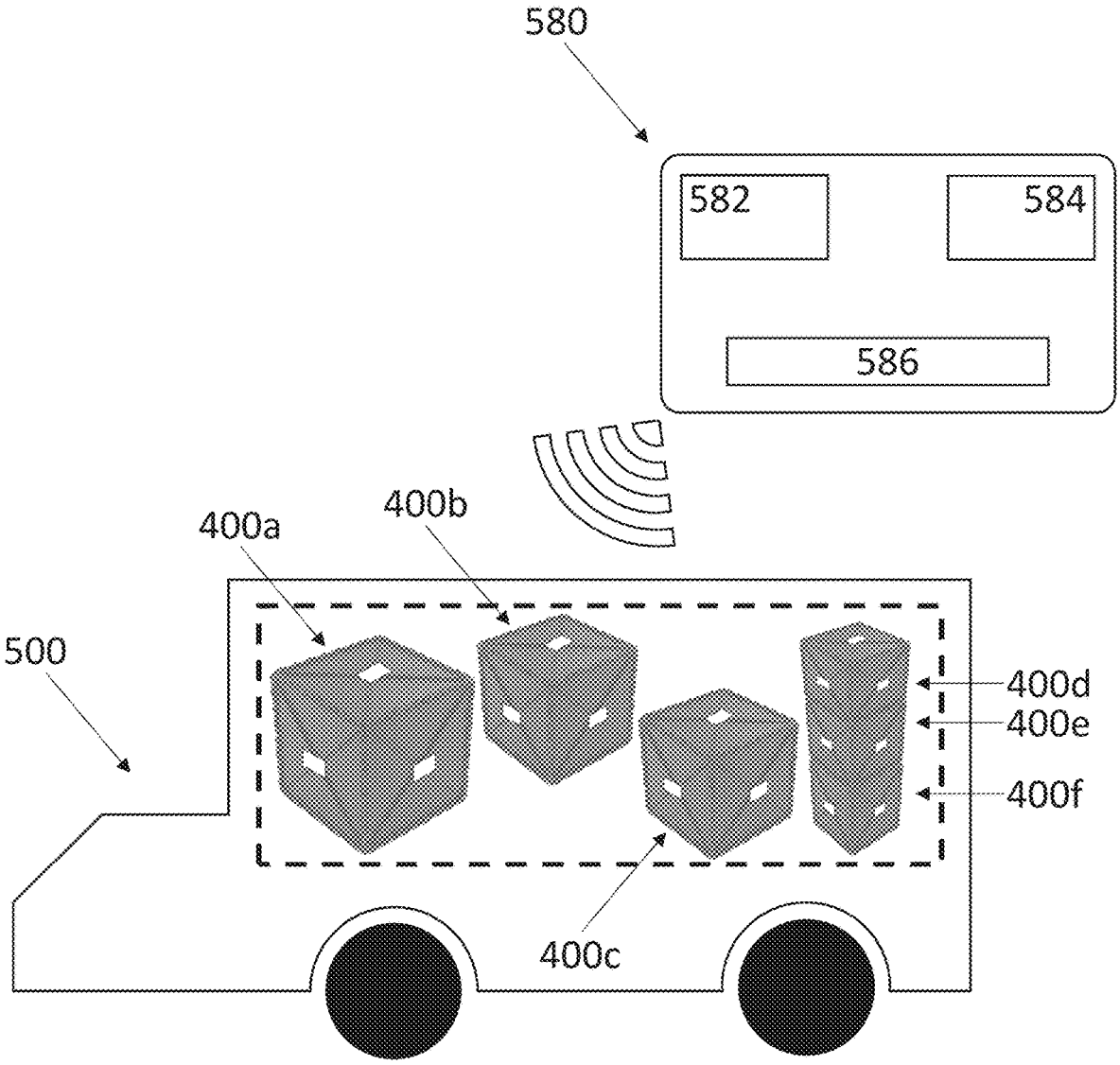
FIGS. 5A-5C illustrate exemplary applications using an embodiment of a container disclosed herein.
Figure 5B:
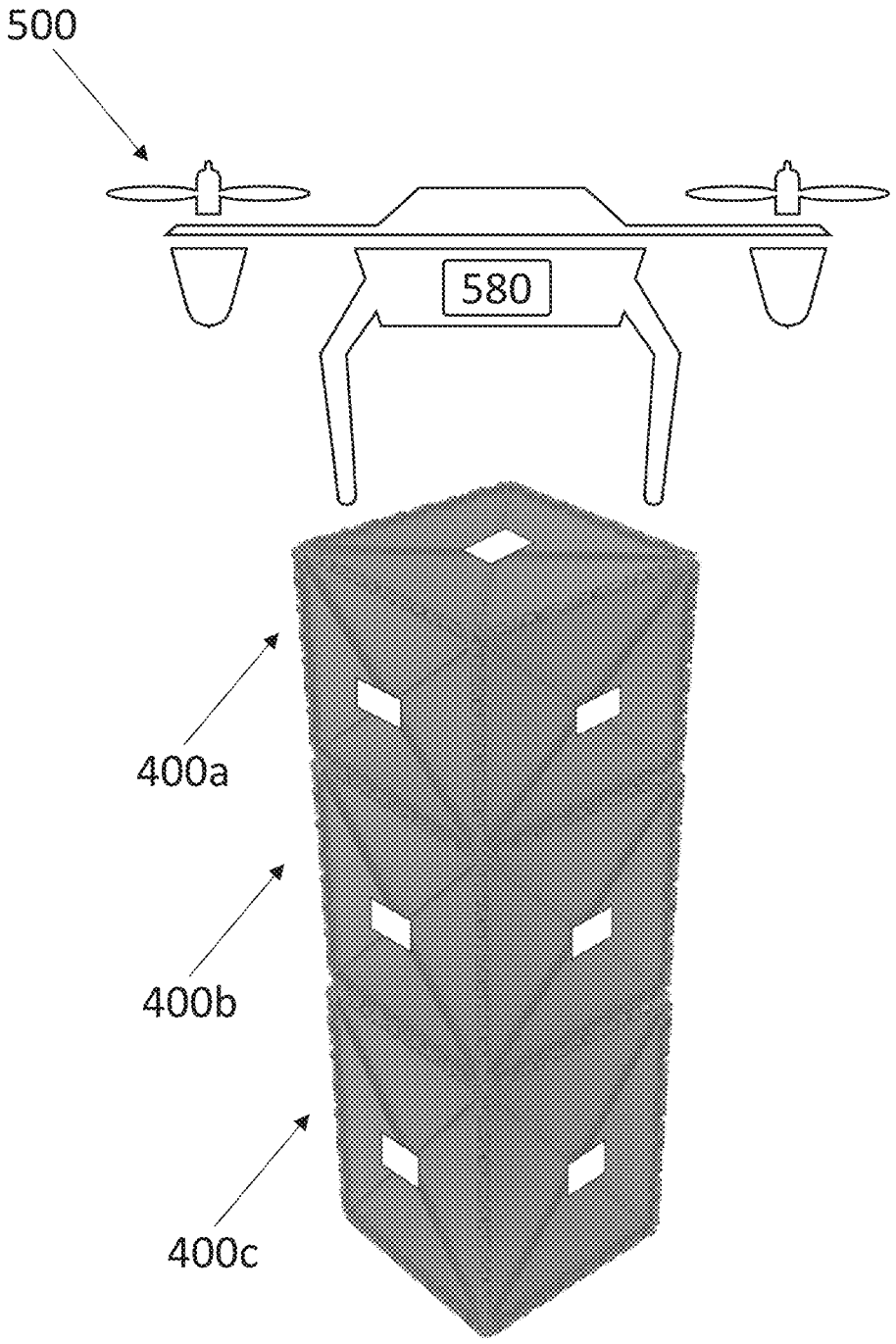
Figure 5C:
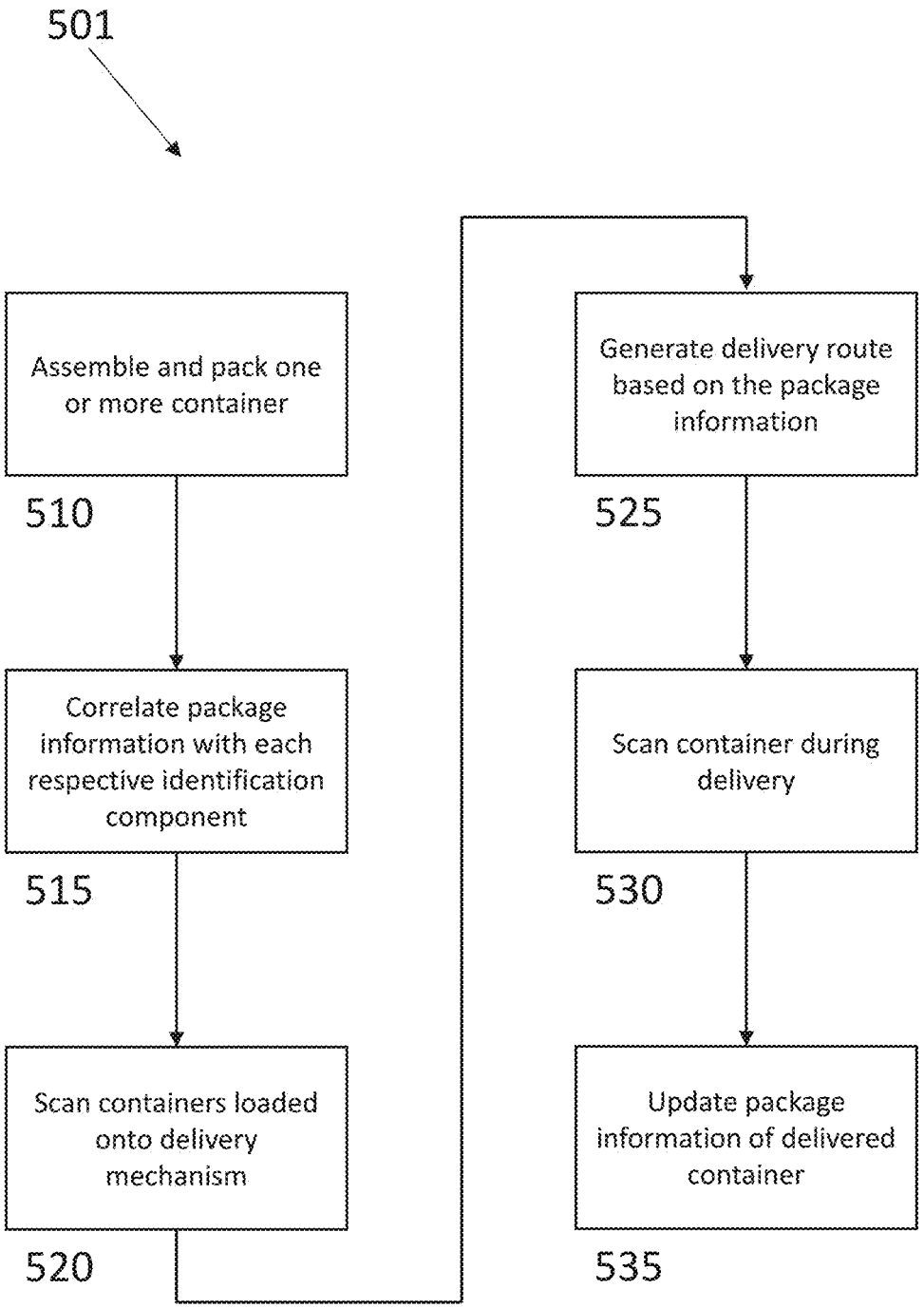

FIGS. 5A-5C provide exemplary embodiments of how identification components, (e.g. identification components 460*a-f*) in connection with a container formed from walls having an identification component. As shown, a delivery mechanism 500 (e.g. truck, drone, postman, airplane, train, etc.) may deliver one or more containers of one or more sizes comprising one or more items. In such embodiments, identification components may comprise package information such as the name of an intended delivery recipient of the container; the address of the intended delivery recipient; delivery tracking information (e.g. date/time of delivery, location of container, history of last locations of the container); and/or contents of the container.

In some embodiments, information corresponding to the identification components may be read via a scanning device, such as scanning device 580. Scanning device 580 may include a processor 582, a user interface 584, and a scanner 586. Scanning device 580 may also include a memory to store scanning information, package information, or the like. Further, scanning device 580 may be connected (e.g., wirelessly or wired) to an additional device or remote server to store and/or retrieve scanning information, package information, or the like.

As shown in FIG. 5A, scanning device 580 may be a handheld device, such as a smartphone, tablet, delivery information acquisition device (DIAD), or the like. Scanning device may also scan (e.g. via scanner 586) packages to view, store, and/or retrieve information regarding the container. A scanning device (e.g. scanning device 580) may also be integrated into the delivery mechanism, such that when packages are received and delivered by the delivery mechanism they are scanned via the scanning device. Additionally or alternatively, scanning device 580 may help with locating a container of interest within the delivery mechanism, a warehouse used to store containers, or the like.

As shown in FIG. 5B, containers may be attached to delivery mechanism rather than loaded in, such as when the delivery mechanism 500 comprises a drone. In some embodiments, the support flanges (e.g. attachment point 145) may be held by the delivery mechanism 500 during transport. Additionally, as shown in FIG. 5B, scanning device 580 may be integrated into delivery mechanism 500.

FIG. 5C provides an exemplary embodiment of a method 501 of delivering one or more containers, such as the containers formed from the walls as disclosed herein. Method 501 may comprise the step of assembling and packing one or more containers (step 510). With respect to step 510, containers may be assembled and packed via an employee and/or automated via a mechanical device (e.g. robotic arm). In some embodiments, the assembly may be partially automatically assembled and then finished manually by an employee. Method 501 additionally includes step 515, regarding correlating package information for each container with the respective one or more identification components. Step 515 may be done by entering in any relevant packaging information (e.g., tangible item(s) that are the contents of the container), scanning the tangible items, receiving packaging information from a seller, or the like. In some instance, step 515 can include using obtained from identification components of the walls. Next, the containers may be loaded one or attached to the delivery mechanism (e.g. delivery mechanism 500) for delivery. In some embodiments, containers are scanned either before, during, or after they are loaded for delivery (step 520). In some embodiments, an employee may manually scan the containers. Additionally or alternatively, the containers may be automatically scanned, as discussed herein. Additionally, a delivery route may be generated based on the addresses of each intended delivery recipient for the containers loaded for delivery (step 525). In some embodiments, a delivery route may be generated when loaded onto a delivery mechanism wherein the next intended destination is the recipient. In some embodiments, the delivery mechanism may be transporting the container from one delivery site to another, wherein generating a delivery route may not be necessary. However in such embodiments, the containers may be organized and/or grouped, such as within a warehouse, based on the address of the intended recipient, and/or the intended delivery date.

Method 501 may also include the containers being scanned during delivery (step 530). For example, the container may be scanned when it is unloaded from the delivery mechanism, dropped off at the designated address, or the like. In some embodiments, a scanning device (e.g. scanning device 580) may periodically scan the containers loaded onto the delivery mechanism, and update which containers have been delivered based on which containers were still identified by the scanning device. When a container has been delivered, or has any update regarding the delivery, the package information may be updated (step 535).

In one embodiment, the method 501 can additionally include a step of using container information in connection with loading a delivery mechanism. This step can, for instance, occur after assembling one or more containers and before loading such containers at a delivery mechanism. For example, the size of each wall used to construct each panel can be known (e.g., obtained from identification components of the walls) and input into an algorithm. Information pertaining to the delivery mechanism can also be input into the algorithm, such as the type of delivery mechanism (e.g., truck, drone, etc.) and/or the volume available for loading containers. The algorithm can then use the input container information and the input delivery mechanism information to output a delivery mechanism assignment for each container. Where the containers are constructed from walls as disclosed herein, the containers may have a variety of sizes suited for the type(s) of items that the containers are to hold. As such, the algorithm can take into account the variability in the sizes of the containers, along with the delivery mechanism information (e.g., available volume), in a manner that optimizes which delivery mechanism a container is to be loaded at (and/or where at the delivery mechanism the container is to be loaded at) and, thereby, can increase the containers loaded onto a delivery mechanism and increase the efficiency of transporting such containers.

Figure 6A:
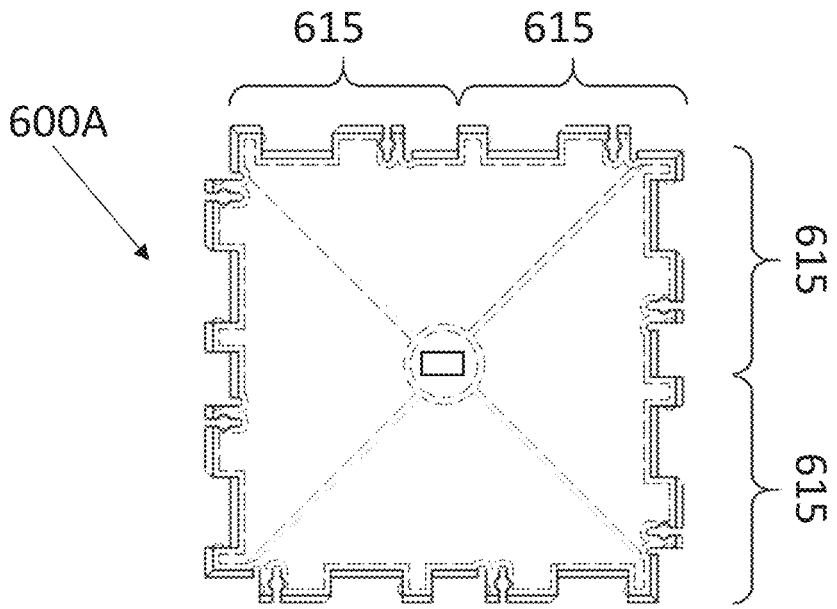
FIG. 6A-6C show different dimensioned embodiments of a wall.
Figure 6B:
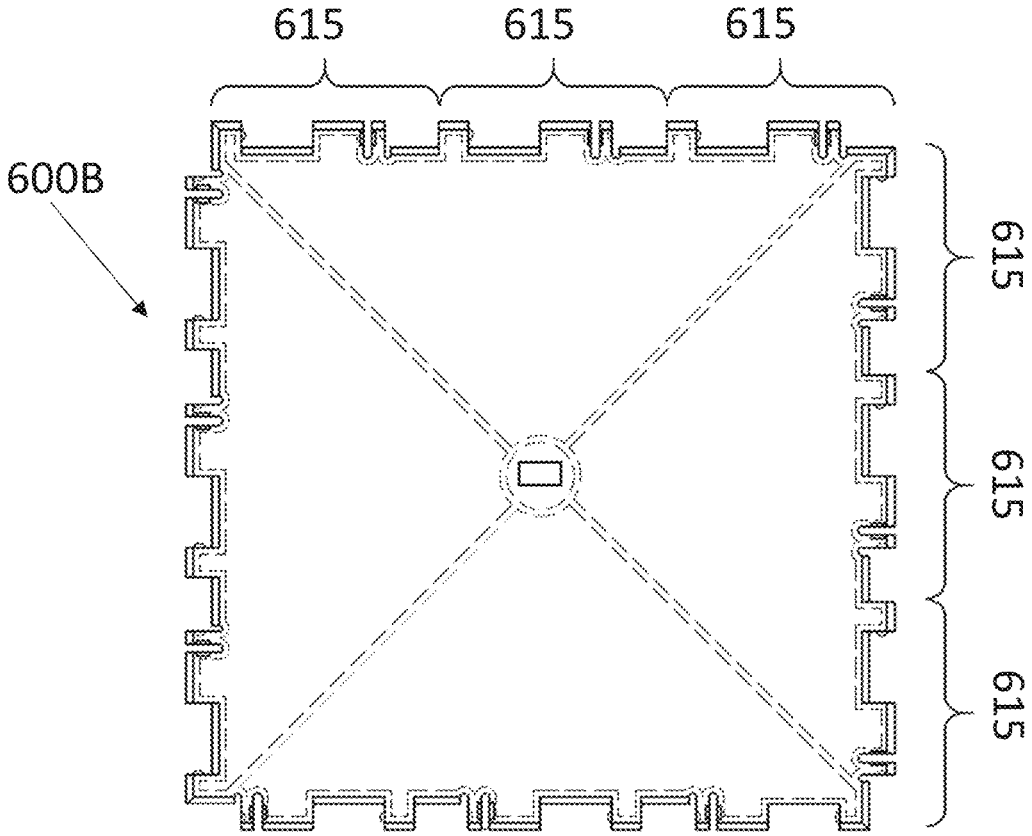
Figure 6C:
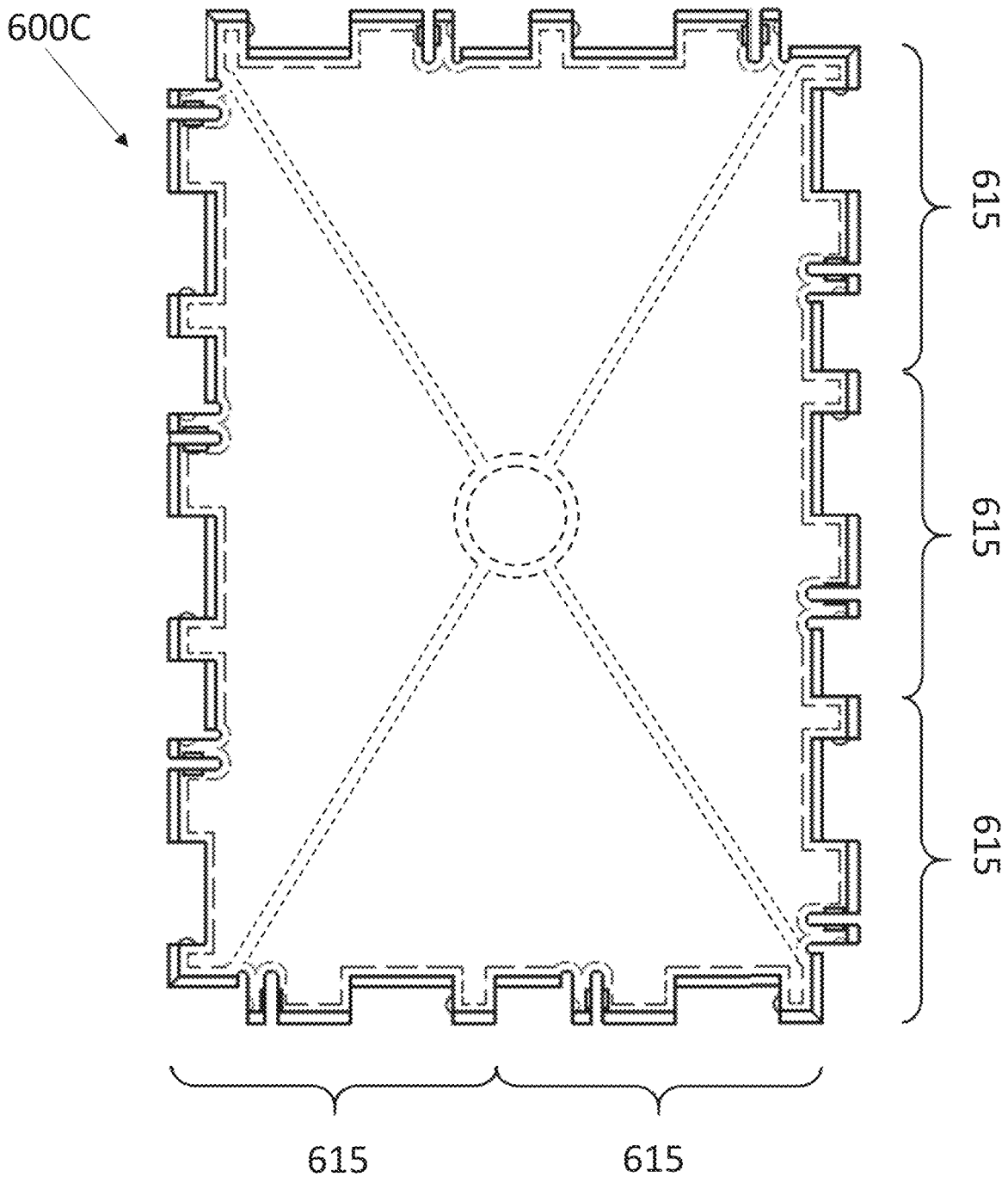

FIGS. 6A-6C show different dimensioned embodiments of a wall. With respect to FIGS. 6A-6C, each side comprises a repeatable pattern, such as described with respect to third side 114 in FIG. 2. As shown, each wall comprises a plurality of repeatable patterns 615 on each side. For example, wall 600A comprises a "2 by 2" pattern wherein repeatable pattern 615 is repeated two times on each side; wall 600B comprises a "3 by 3" pattern wherein repeatable pattern 615 is repeated three times on each side; and wall 600C comprises a "2 by 3" pattern wherein repeatable pattern 615 is repeated two times on one side and three times on the adjacent sides. In some embodiments, repeatable pattern 615 is a consistent size throughout various sizes of walls. For example, the repeatable pattern 615 may be the same throughout walls 600A-C such that various combinations of walls 600A-C may be combined together to make various sized three-dimensional shapes.

Figure 7A:
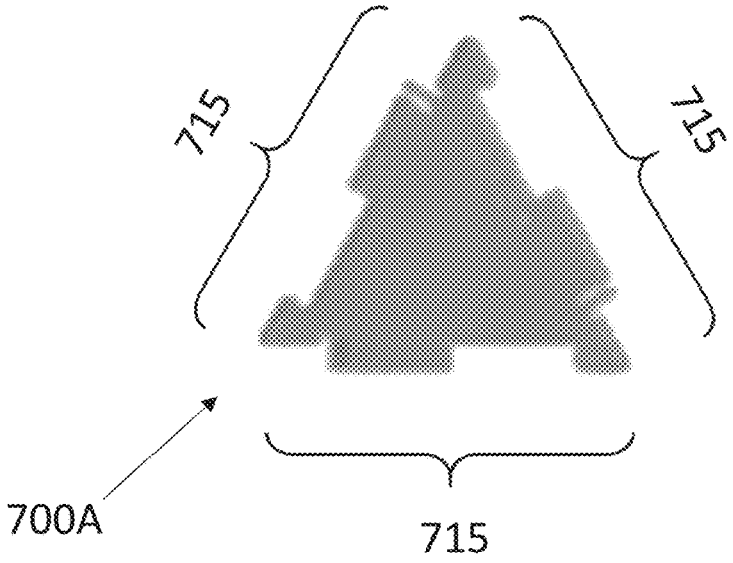
FIGS. 7A and 7B show different geometric shaped embodiments of a wall.
Figure 7B:
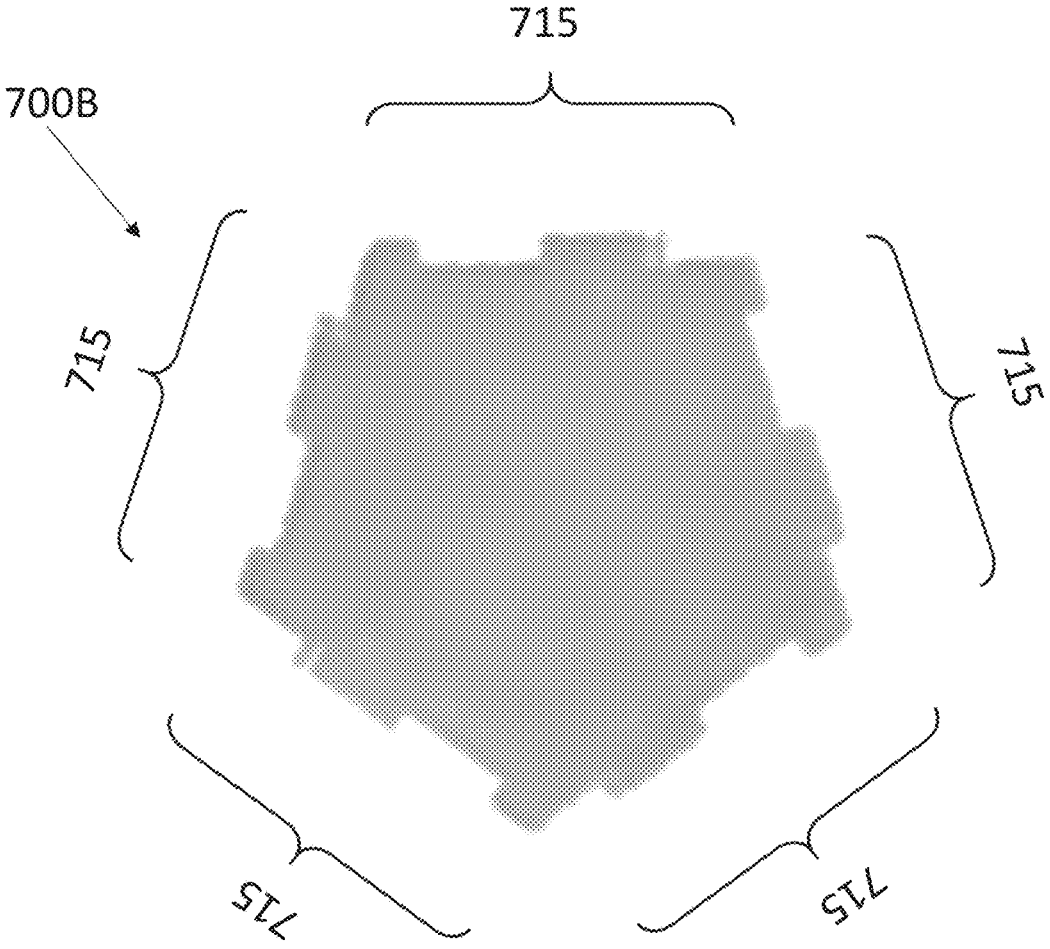

FIGS. 7A-7B show different geometric shaped embodiments of a wall. FIG. 7A illustrates a triangular wall 700A, where each wall comprises repeatable pattern 715 on each side. FIG. 7B illustrates a pentagonal wall 700B, where each wall comprises repeatable pattern 715 on each side. In some embodiments, repeatable pattern 715 can be the same as, or similar to, what is disclosed with respect to third side 114 in FIG. 2. Additionally, each side of the walls shown in FIGS. 7A-7B may comprise a plurality of repeatable patterns 715. For conciseness, only a handful of additional wall shapes and sizes (e.g. FIGS. 6A-6C and 7A-7B); however, other shapes and sizes are within the scope of the present disclosure.

Figure 8:
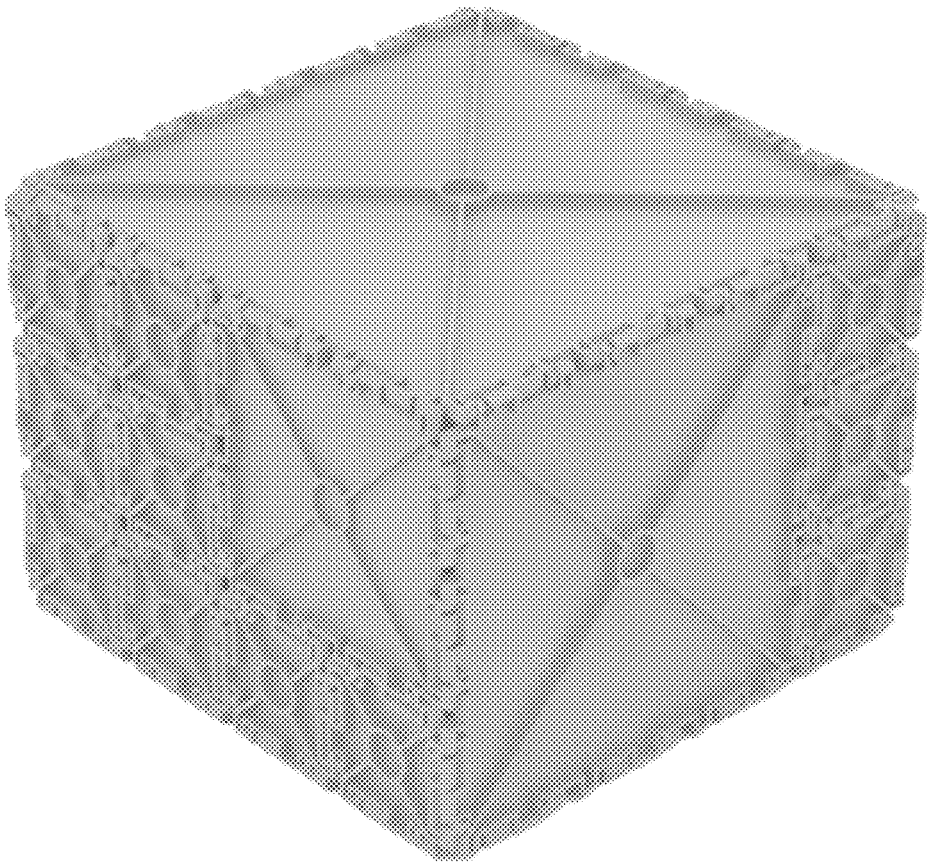
FIG. 8 is an exemplary embodiment of connecting multiple walls to form a container.

Having various sized walls which are attachable, and rotatable (e.g., pivotable about the attached sides), to one another can allow for the construction of custom sized containers. For example, to make a large container, one may use a larger wall or may combine various smaller walls to construct the container. FIG. 8 provides an example of various sized walls being combined together to construct a larger container. The example shown in FIG. 8 includes support flanges, and attachment points, facing outward such that these structures are present on an exterior of the container. In other examples, the support flanges, and attachment points, can face inward toward the interior volume of the container such that these structures are present on an interior of the container. In one example, the container can have support flanges, and attachment points, on both sides of the walls making up the container such that these structures are present on the exterior of the container, facing outward, and on the interior of the container, facing inward.

In various embodiments, the containers may be cubes or rectangular prisms, and thus be made up of multiple walls shaped as squares and rectangles. In some embodiments, each container side can be made up of one or more walls which when attached make a rectangular side. However, in some embodiments, the containers may comprise other shapes, such as various prisms, pyramids, and polyhedrons which may comprise walls which are not rectangular. FIG. 6 provides a few additional shaped walls, such as wall 600A shaped as a triangle and wall 600B shaped as a pentagon. Even though not shown, various other shapes known to one of ordinary skill in the art may be used. In some embodiments, the walls comprise the same repeatable pattern (e.g. repeatable pattern 615) on the external edge allowing the walls to be combined together to make a geometrical net and be folded into a container.

Figure 9:
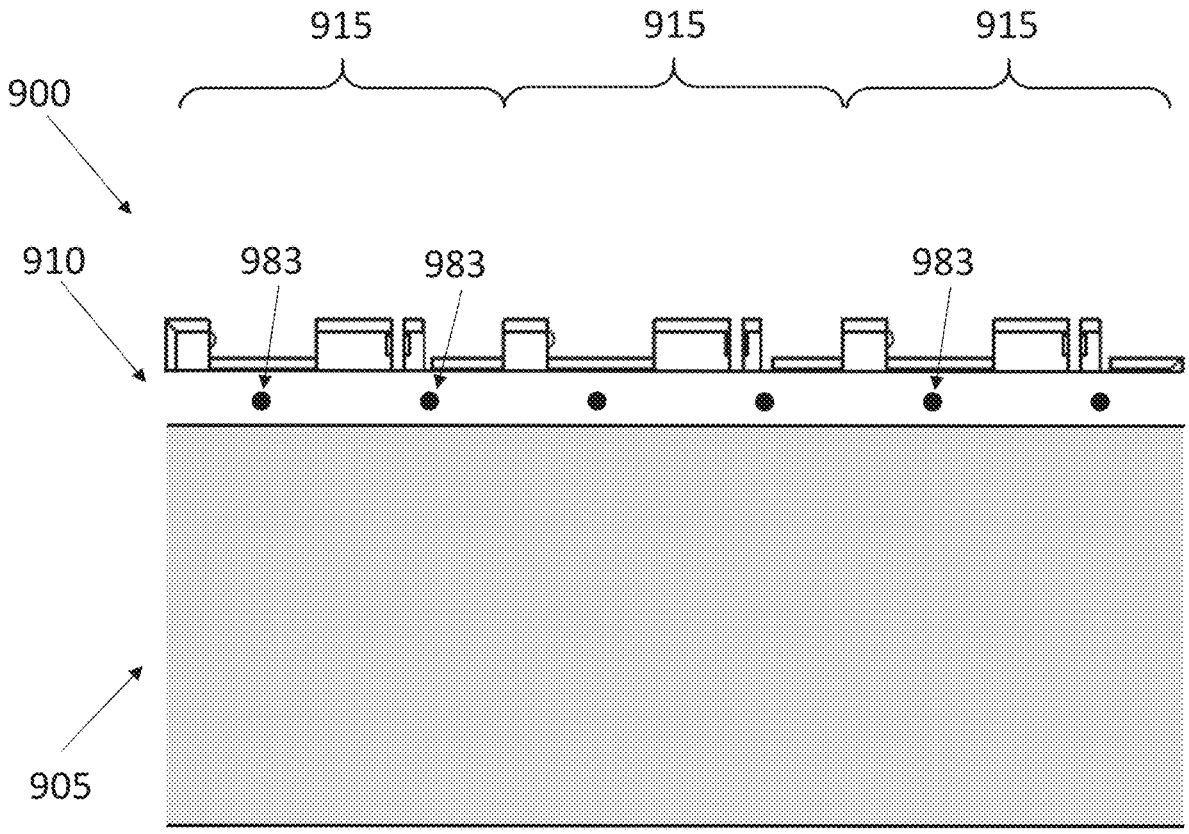
FIG. 9 shows an exemplary side portion attached to a substrate.

As disclosed herein, walls may comprise a single component with three or more sides having the repeatable pattern (e.g. walls 600A-C comprising repeatable pattern 615). However, sides comprising the repeatable pattern (e.g. repeatable pattern 615) may be attached to other components. FIG. 9 provides an exemplary attachable wall 900 comprising a side 910 having repeatable pattern 915 attached to base 905. In some embodiments, side 910 and base 905 may comprise similar materials. Alternatively, side 910 and base 905 may comprise different materials, such as side 910 comprising a plastic and/or polymer and base 905 may comprise wood and/or metal.

Side 910 may be attached base 905 using various techniques, such as with attachment points 983. In some embodiments, side 910 may be inserted over base 905 and attached using attachment points 983, such as via nails, screws, pins, dowels, etc. Additionally or alternatively, side 910 may slide and/or snap onto base 905.

In some embodiments, attachable wall 900 may be manufactured at a plurality of lengths and then either chosen based on size or cut down to be a size of interest. Additionally or alternatively, the attachable wall 900 may be manufactured with a plurality of different repeatable patterns wherein a particular repeatable pattern is chosen based on the characteristics of the container, the potential contents of the container, or the like. For example, the length and/or width of repeatable pattern (e.g. repeatable pattern 915) may be adjusted based on the material used, the potential size of the container, and the potential contents of the container. For example, a smaller container may comprise a repeatable pattern which is finer (e.g. the repeatable pattern is repeated more often and has a smaller width/length) wherein a larger container may comprise a larger repeatable pattern. In such embodiments, walls may be chosen based on the size of the wall and based on the size of the repeatable pattern.

Various embodiments have been described, such examples are non-limiting, and do not define or limit the scope of the invention in any way. Rather, these and other examples are within the scope of the following claims.

What is claimed is:

1. A system of attachable walls comprising:

a first wall and a second wall, each of the first wall and the second wall comprising:

a first side having a base surface and a repeatable pattern, the repeatable pattern comprising:

a first lateral segment a second lateral segment adjacent to the first lateral segment, the second lateral segment comprising a resilient first flange extending outward of the base surface of the first side and a flexible finger extending outward of the base surface of the first side, the flexible finger having a first side facing the resilient first flange, a second side, opposite the first, facing away from the resilient first flange and toward the first lateral segment, and a first mating component positioned on the second side of the flexible finger, the second lateral segment further comprising a receptacle formed by a first receptacle portion recessed, at least in a direction parallel to the base surface, into the resilient first flange and a second receptacle portion recessed, at least in the direction parallel to the base surface, into the first side of the flexible finger, the receptacle configured to receive a pin and hold the pin at the receptacle such that, when the pin is inserted into the receptacle, the flexible finger is prevented from flexing toward the resilient first flange;

a third lateral segment adjacent to the second lateral segment such that the second lateral segment is between the first lateral segment and the third lateral segment; and a fourth lateral segment adjacent to the third lateral segment such that the third lateral segment is between the second lateral segment and the fourth lateral segment, the fourth lateral segment including a second flange extending away from the base surface of the first side, the second flange including a second mating component positioned on a side of the second flange facing the third lateral segment; and wherein the first side of the first wall is configured to engage with the first side of the second wall such that:

the first lateral segment of the first wall receives the second flange of the fourth lateral segment of the second wall;

the first lateral segment of the second wall receives the second flange of the fourth lateral segment of the first wall;

the third lateral segment of the first wall receives the flexible finger and the resilient first flange of the second lateral segment of the second wall;

the third lateral segment of the second wall receives the flexible finger and the resilient first flange of the second lateral segment of the first wall;

the first mating component of the first wall engages the second mating component of the second wall; and the first mating component of the second wall engages the second mating component of the first wall; and when the first side of the first wall engages the first side of the second wall, the first wall is rotatable relative to the second wall about a rotational axis defined by the first mating component of the first wall and the second mating component of the second wall wherein the receptacle is spaced outward from the base surface and the receptacle is spaced apart from the rotational axis that extends between the first mating component of the first wall and the second mating component of the second wall.

2. The system of claim 1, wherein at least one of the first wall and the second wall comprises a plurality of sides with the repeatable pattern.

3. The system of claim 2, wherein at least one side comprises a plurality of the repeatable pattern.

4. The system of claim 3, wherein every side of the first wall and the second wall comprise the repeatable pattern.

5. The system of claim 4, wherein the first wall and the second wall comprise at least three sides.

6. The system of claim 4, wherein the first wall and the second wall consist of four sides.

7. The system of claim 6, wherein the first wall and the second wall are squares.

8. The system of claim 4, further comprising four or more walls comprising sides with the repeatable pattern; and wherein the walls can be assembled to form a container, wherein the container is a polyhedron.

9. The system of claim 8, further comprising six walls, and wherein the walls can be assembled to form the container, wherein the container is rectangular prism.

10. The system of claim 9, wherein the walls can be assembled to form the container, wherein the container is a cube.

11. The system of claim 8, wherein each face of the container comprises a single wall.

12. The system of claim 8, wherein one or more faces of the container comprises a plurality of walls.

13. The system of claim 8, wherein at least one of the walls comprises an identification component.

14. The system of claim 13, wherein the identification component comprises an RFID tag.

15. The system of claim 13, wherein each wall comprises a unique identification component such that the unique identification component for the container is based on every identification component comprised within the container.

16. The system of claim 15, further comprising a scanning device configured to read the one or more identification components via a scanner.

17. The system of claim 16, wherein the scanning device further comprises a processor, a user interface, and a memory, the processor being in communication with the scanner, the user interface, and the memory and being configured to:

determine the unique identification component associated with the container;

receive and input from the user interface indicating additional information associated with the container; and store together in the memory the additional information and the unique identification component associated with the container.

18. The system of claim 17, wherein the additional information is selected from the group consisting of: information regarding the contents of the container; a name of an intended delivery recipient of the container; and an address of the intended deliver recipient of the container.

19. The system of claim 17, wherein the container is a subset of walls selected from a plurality of walls, and wherein for each of a plurality of containers, the container comprises a subset of walls selected from a plurality of walls.

20. The system of claim 1, the first wall is rotatable relative to the second wall such that angles between 180 degrees and 90 degrees can be formed between the first wall and the second wall.

21. The system of claim 20, wherein:

the first side of the first wall comprising a first angle between an external surface of the first wall and distal portions of the first side, the first angle being an acute angle; and the first side of the second wall comprising a second angle between an external surface of the second wall and distal portions of the first side, the second angle being an acute angle.

22. The system of claim 21, wherein the first angle and the second angle are between 30 degrees and 60 degrees.

23. The system of claim 22, wherein the first angle and the second angle are the same.

24. The system of claim 1, further comprising a pin configured to enter the receptacle formed between the resilient first flange and the flexible finger of either the first wall or the second wall such that, when the pin is inserted into the receptacle, the flexible finger is prevented from flexing toward the resilient first flange.

25. The system of claim 24, wherein:

the first side of the first wall and the second side of the second wall are engageable by:

flexing the flexible finger of the first wall away from a neutral position and toward the resilient first flange of the first wall until a first engagement member on the flexible finger of the first wall aligns with a second engagement member on the second flange of the second wall, wherein the flexible finger of the first wall moves toward the neutral position and the first engagement member on the flexible finger of the first wall engages the second engagement member on the second flange of the second wall; and flexing the flexible finger of the second wall away from a neutral position and toward the resilient first flange of the second wall until the first engagement member on the flexible finger of the second wall aligns with the second engagement member on the second flange of the first wall, wherein the flexible finger of the second wall moves toward the neutral position and the first engagement member on the flexible finger of the second wall engages the second engagement member on the second flange of the first wall; and when the pin is inserted into the receptacle formed between the resilient first flange and the flexible finger on the first side of the first wall, the flexible finger is inhibited from flexing toward the resilient first flange such that disengagement of the engaged first wall and second wall is inhibited.

26. The system of claim 25, wherein the first side of the first wall and the second side of the second wall are engageable by an automated machine, and wherein:

the first wall and the second wall are selected by the automated machine from a plurality of walls; and the first wall is selected via a first attachment point located on a surface of the first wall; and the second wall is selected via a second attachment point located on a surface of the second wall.

* * * * *